US009355553B1

(12) United States Patent
Mui

(10) Patent No.: US 9,355,553 B1
(45) **Date of Patent: *May 31, 2016**

(54) RELAYING KEY CODE SIGNALS THROUGH A REMOTE CONTROL DEVICE

(75) Inventor: Daniel SauFu Mui, San Jose, CA (US)

(73) Assignee: UEI Cayman Inc. (KY)

( * ) Notice: Subject to any disclaimer, the term of this patent is extended or adjusted under 35 U.S.C. 154(b) by 1150 days.

This patent is subject to a terminal disclaimer.

(21) Appl. No.: 13/068,820

(22) Filed: May 21, 2011

Related U.S. Application Data

(63) Continuation of application No. 12/462,526, filed on Aug. 4, 2009, now Pat. No. 8,004,389, which is a continuation of application No. 10/737,029, filed on Dec. 16, 2003, now Pat. No. 7,589,642.

(51) Int. Cl.
*G08C 19/12* (2006.01)
*G08C 15/04* (2006.01)
*G08C 17/02* (2006.01)

(52) U.S. Cl.
CPC ..... *G08C 15/04* (2013.01); *G08C 17/02* (2013.01)

(58) Field of Classification Search
CPC ..... G08C 15/04; G08C 17/02; G08C 19/22
USPC ..... 340/13.24, 12.5, 12.22
See application file for complete search history.

(56) References Cited

U.S. PATENT DOCUMENTS

| | | | | |
|---|---|---|---|---|
| 4,005,428 A | | 1/1977 | Graham | 340/825.75 |
| 5,201,067 A | * | 4/1993 | Grube et al. | 455/556.1 |
| 5,410,326 A | | 4/1995 | Goldstein | 348/134 |
| 5,595,342 A | | 1/1997 | McNair et al. | 236/51 |
| 5,671,267 A | | 9/1997 | August et al. | 379/61 |
| 5,724,106 A | * | 3/1998 | Autry et al. | 348/734 |
| 5,963,624 A | | 10/1999 | Pope | 379/110.01 |
| 6,008,735 A | * | 12/1999 | Chiloyan et al. | 340/12.24 |
| 6,747,568 B1 | | 6/2004 | Teskey | 340/825.72 |
| 6,819,259 B2 | | 11/2004 | Yamaguchi | 340/825.69 |
| 6,915,109 B2 | | 7/2005 | Wouters et al. | 455/45 |
| 7,525,855 B2 | | 4/2009 | Kagan | 365/189.17 |
| 2002/0130803 A1 | | 9/2002 | Conway et al. | 341/176 |
| 2005/0151726 A1 | | 7/2005 | Wouters | 345/172 |

* cited by examiner

*Primary Examiner* — Vernal Brown

(74) *Attorney, Agent, or Firm* — Imperium Patent Works; Darien K. Wallace

(57) ABSTRACT

Upon receiving a keystroke indicator signal from a remote control device, a key code generator device identifies a codeset usable to communicate with a selected consumer device. The keystroke indicator signal contains an indication of a pressed key, which corresponds to a function of the selected consumer device. Using the identified codeset and the key indication, the key code generator device generates a key code and modulates that key code onto a radio frequency carrier signal, thereby generating a first key code signal. The remote control device receives the first key code signal from the key code generator device and modulates the key code onto an infrared frequency carrier signal, thereby generating a second key code signal. The remote control device relays the key code to the selected consumer device in the second key code signal. The key code causes the selected consumer device to perform the desired function.

2 Claims, 4 Drawing Sheets

BINARY TRANSMISSION

PULSE WIDTH MODULATION

KEY CODE

RELAYING KEY CODE SIGNALS THROUGH A REMOTE CONTROL DEVICE

CROSS REFERENCE TO RELATED APPLICATION

This application is a continuation of, and claims priority under 35 U.S.C. §120 from, nonprovisional U.S. patent application Ser. No. 12/462,526 entitled "Relaying Key Code Signals Through a Remote Control Device," filed on Aug. 4, 2009 now U.S. Pat. No. 8,004,389, the subject matter of which is incorporated herein by reference. Application Ser. No. 12/462,526, in turn, is a continuation of U.S. patent application Ser. No. 10/737,029 entitled "Relaying Key Code Signals Through a Remote Control Device," now U.S. Pat. No. 7,589,642, filed on Dec. 16, 2003, the subject matter of which is incorporated herein by reference.

TECHNICAL FIELD

The present invention relates generally to remote control devices and, more specifically, to relaying key code signals through a remote control device to operate an electronic consumer device.

BACKGROUND

Most households today possess multiple types of electronic consumer devices, such as televisions, stereo radios, digital video disk players, video cassette recorders, set-top cable television boxes and set-top satellite boxes. Manufacturers of such electronic devices typically supply a remote control device along with each electronic device. It is, therefore, common for a consumer who has multiple electronic devices to have multiple remote control devices.

A remote control device typically controls a selected electronic consumer device by transmitting infrared key code signals to the selected electronic consumer device. The infrared signals contain key codes of a codeset associated with the selected electronic consumer device. Each key code corresponds to a function of the selected electronic device, such as power on, power off, volume up, volume down, play, stop, select, channel up, channel down, etc. In order to avoid the situation where a remote control device unintentionally operates an electronic consumer device that is associated with a different remote control device, manufacturers sometimes use distinct codesets for the communication between various electronic consumer devices and their associated remote control devices. The codesets can differ from each other not only by the bit patterns assigned to various functions of the associated electronic consumer device, but also by the timing information that describes how the key codes should be modulated onto carrier signals to generate key code signals.

Consumers may find it inconvenient to operate their electronic devices using multiple remote control devices. Thus, a consumer may wish to operate multiple electronic consumer devices using a single remote control device. A single remote control device can store many codesets so that the remote control device can control a corresponding large number of different electronic consumer devices. There are, however, thousands of codesets in use in electronic consumer devices today. Manufacturers of remote control devices, however, may wish to limit the memory on their remote control devices to a size that is insufficient to store the thousands of existing codesets.

A system is sought for enabling a remote control device to control a selected one of multiple different electronic consumer devices without requiring the codeset associated with the selected electronic consumer device to be stored on the remote control device.

SUMMARY

A system for relaying a key code through a remote control device to an electronic consumer device allows the electronic consumer device to be controlled without storing the associated codeset on the remote control device. Upon receiving a keystroke indicator signal from a remote control device, a key code generator device, such as a set-top box, identifies the particular codeset usable to communicate with the selected electronic consumer device. The keystroke indicator signal contains an indication of a key on the remote control device that was pressed, which corresponds to a function of the selected electronic consumer device. Using the identified codeset and the indication of the pressed key, the key code generator device generates a key code and modulates that key code onto a radio frequency carrier signal, thereby generating a first key code signal. The remote control device receives the first key code signal from the key code generator device and modulates the key code onto an infrared frequency carrier signal, thereby generating a second key code signal. The remote control device relays the key code to the selected electronic consumer device in the second key code signal. The key code causes the selected electronic consumer device to perform the desired function. The key code is not stored on the remote control device in a permanent manner, but rather the key code is relayed through the remote control device.

In another embodiment, a third key code signal (which may, for example, be a radio frequency signal) is communicated directly from the key code generator device to an electronic consumer device. A key code contained in the third key code signal causes the electronic consumer device to perform a desired function.

In yet another embodiment, the system automatically determines which codeset is usable to communicate with a selected electronic consumer device. The key code generator device sends key codes for one particular function from among a series of codesets one-by-one to the selected electronic consumer device. When the key code from one of the codesets causes the electronic consumer device to perform the desired function, electromagnetic noise is introduced into electrical power wiring through which both the electronic consumer device and the key code generator device receive power. When the key code generator device detects this noise on the electrical power wiring, the key code generator device identifies the codeset corresponding to the last transmitted key code to be the codeset usable to communicate with the selected electronic consumer device.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
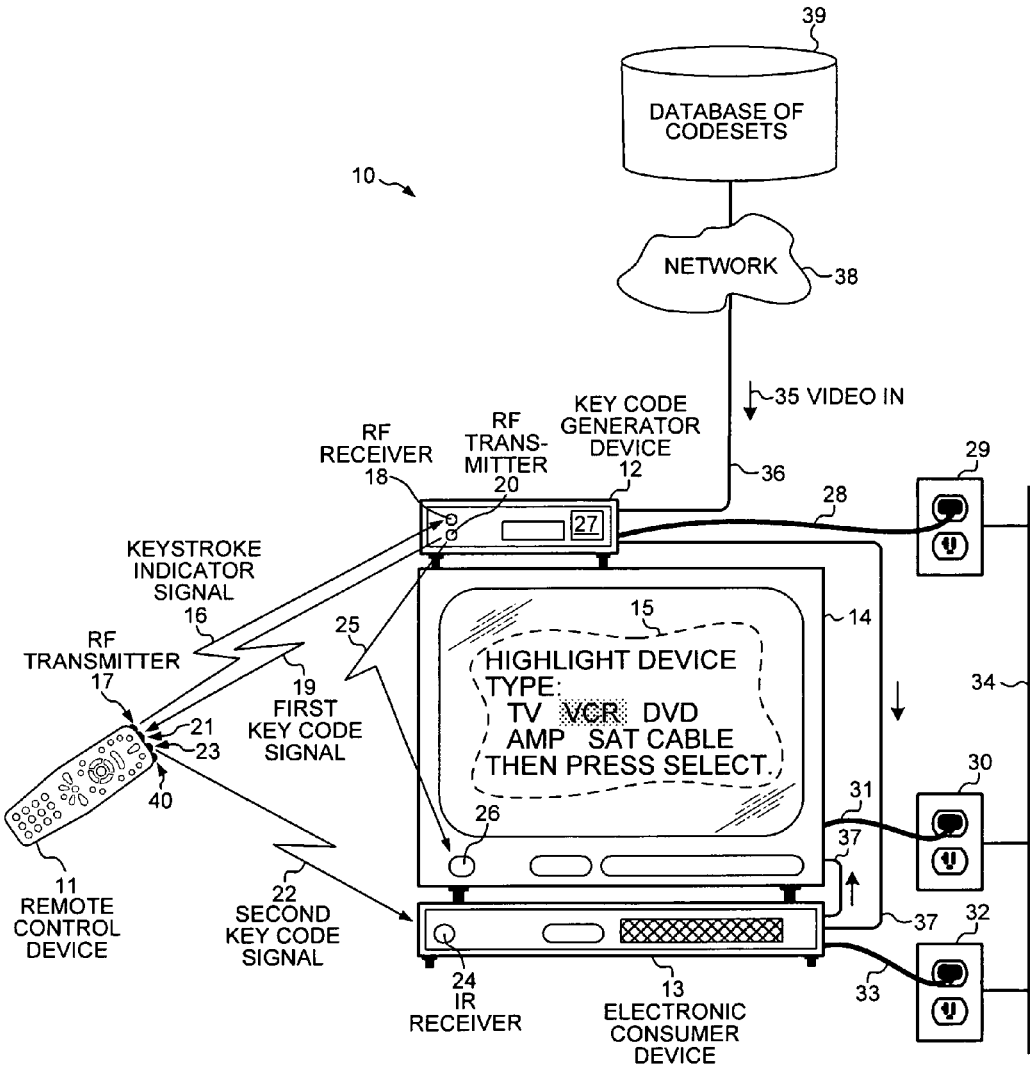
FIG. 1 is a schematic diagram of a system for relaying key code signals through a remote control device.
Figure 2:
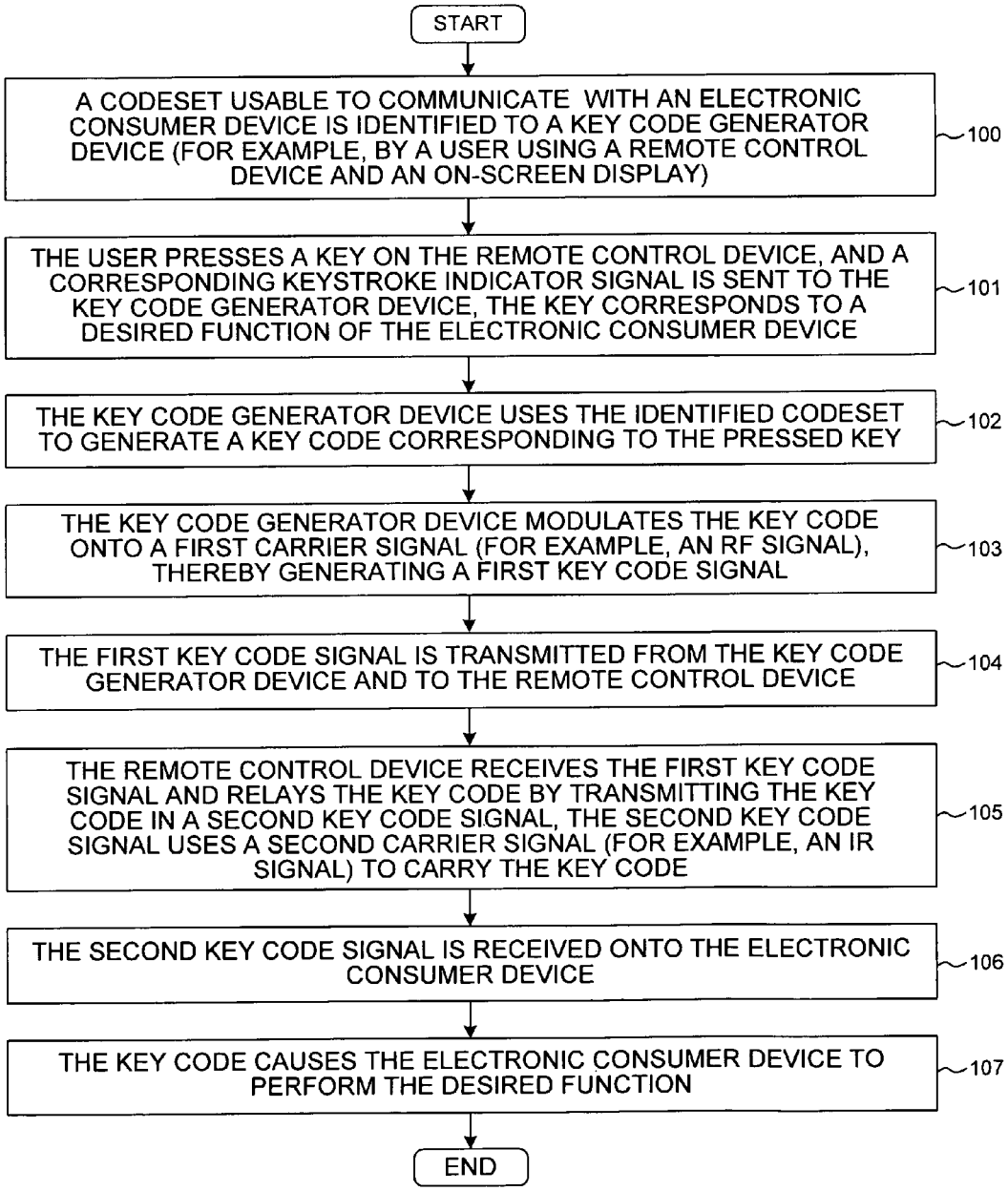
FIG. 2 is a flowchart of a method for relaying key code signals through a remote control device.

FIG. 1 is a diagram of a system 10 for relaying a key code through a remote control device 11 to an electronic consumer device in accordance with the present invention. FIG. 2 is a flowchart that illustrates a method of operation of system 10. System 10 includes a key code generator device 12, remote control device 11, a first electronic consumer device 13 and a second electronic consumer device 14. In this example, second electronic consumer device 14 is a television set.

In a first step (step 100), key code generator device 12 determines the appropriate codeset that controls the type, brand and model of the particular electronic consumer device that is to be controlled. A user uses remote control device 11 to respond to an on-screen display 15 on the screen of television set 14 to step through a sequence of menu screens to identify the codeset corresponding to the device that is to be controlled. The user does this by identifying, on on-screen display 15, the type, brand and model of the particular electronic consumer device. In this example, the user is identifying first electronic consumer device 13, which is a video cassette recorder (VCR) manufactured by Sony with model number 8000. In FIG. 1, the user is identifying the device type by highlighting the choice "VCR" on the on-screen display. In another example, subsequent to controlling VCR 13, the user may wish to control television set 14, which is a "Gold" model manufactured by RCA. In that case, the user begins identifying television set 14 by highlighting the choice "TV".

In the present example, key code generator device 12 is a set-top box. Key code generator device 12 generates the on-screen displays and communicates with television set 14 such that key code generator device 12 identifies one of a plurality of codesets that corresponds to one of the electronic consumer devices identified by the user, such as VCR 13 or television set 14. System 10 uses the appropriate codeset to enable remote control device 11 to communicate with VCR 13 and television set 14.

Next (step 101), the user presses a key on remote control device 11. This key is associated with a function that the user wants performed by an electronic consumer device. For example, the function may be to turn on the power of VCR 13. When the user presses the "VCR power-on" key on remote control device 11, remote control device 11 transmits a keystroke indicator signal 16 from a radio frequency (RF) transmitter 17 on remote control device 11. Alternatively, two or more keys on remote control device 11 may be associated with a single function, such as turning on the power of VCR 13. In that case, the user presses a "VCR" key and then a "power-on" key to cause remote control device 11 to transmit keystroke indicator signal 16. Keystroke indicator signal 16 is transmitted as a signal in a radio frequency band to an RF receiver 18 on key code generator device 12.

There are multiple forms in which an indication of the pressed key, as well as the identity of the electronic consumer device that is to perform the associated function, can be communicated in keystroke indicator signal 16 from remote control device 11 to key code generator device 12. In one embodiment, the indication of the pressed key is a key code comprised of a standardized system code and standardized key data. In the present example, the standardized system code identifies the type of electronic consumer device that is to be controlled, such as a TV, a VCR, a DVD player, a stereo amplifier, a satellite receiver or a cable receiver. The standardized system code and key data are part of a commonly used codeset that is stored on remote control device 11. Remote control device 11 uses any one of a number of commonly used modulation techniques to modulate the system code and key data to form keystroke indicator signal 16. For example, a microcontroller on remote control device 11 uses timing information associated with the commonly used codeset to generate a pulse width modulated keystroke indicator signal 16.

In another embodiment, the indication of the pressed key includes a proprietary identification code identifying the pressed key, as well as a proprietary identification code corresponding to the type of the electronic consumer device that is to be controlled. The proprietary identification codes are understood by key code generator device 12, but are not standardized codes that are understood by electronic consumer devices. Remote control device 11 uses any one of a number of commonly used modulation techniques to modulate the proprietary identification codes onto keystroke indicator signal 16.

Whether remote control device 11 communicates with key code generator device 12 through a standardized codeset or through proprietary identification codes, codes may be included that do not correspond to pressed keys or functions that are to be performed on electronic consumer devices. For example, in response to receiving any signal from remote control device 11, key code generator device 12 may return a code to remote control device 11 causing a light emitting diode (LED) display on remote control device 11 to turn on.

Next (step 102), key code generator device 12 determines which key code of the codeset previously identified in step 100 corresponds to the pressed key.

Figure 3:
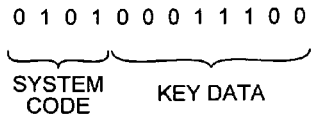
FIG. 3 is an illustration of a key code transmitted within a key code signal.

FIG. 3 illustrates one example of a key code from a commonly used codeset. The key code is comprised of a standardized system code and standardized key data. Both the system code and the key data are digital values. The 12-bit key code includes a 4-bit system code [0101] and 8-bit key data [00011100]. In the present example, the key code is the key code in the identified codeset that corresponds to the "VCR power-on" key of remote control device 11.

Next (step 103), key code generator device 12 modulates the key code for the power-on function of VCR 13 onto a first carrier signal, thereby generating a first key code signal 19. In this example, the first carrier signal is an RF signal. An RF signal for purposes of this patent document is an electromagnetic signal having a frequency between thirty hertz and three hundred gigahertz.

Figure 4:
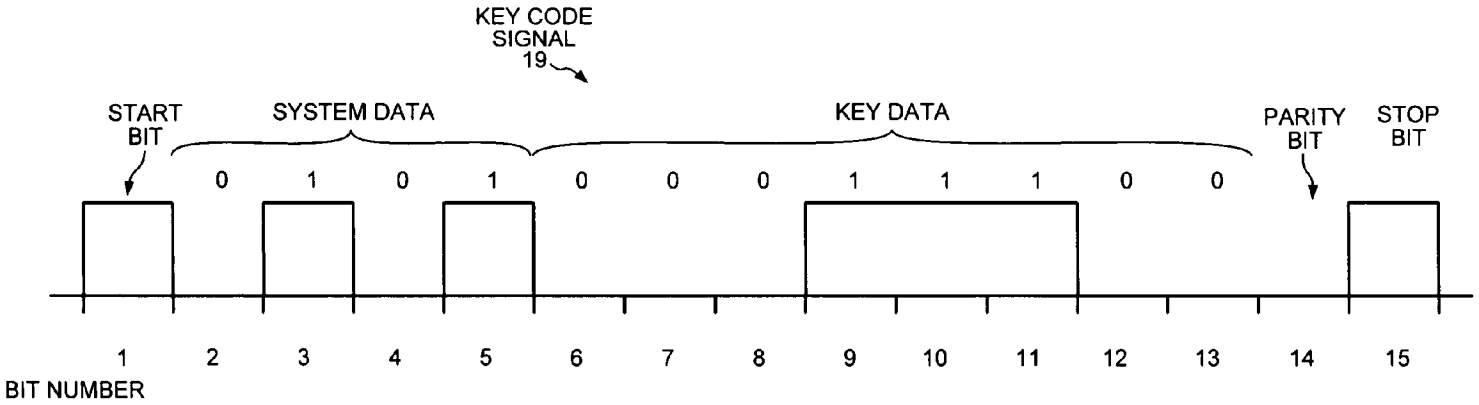
FIG. 4 is a waveform diagram of a first example of a key code signal transmitted by a remote control device in the system of FIG. 1.
Figure 5:
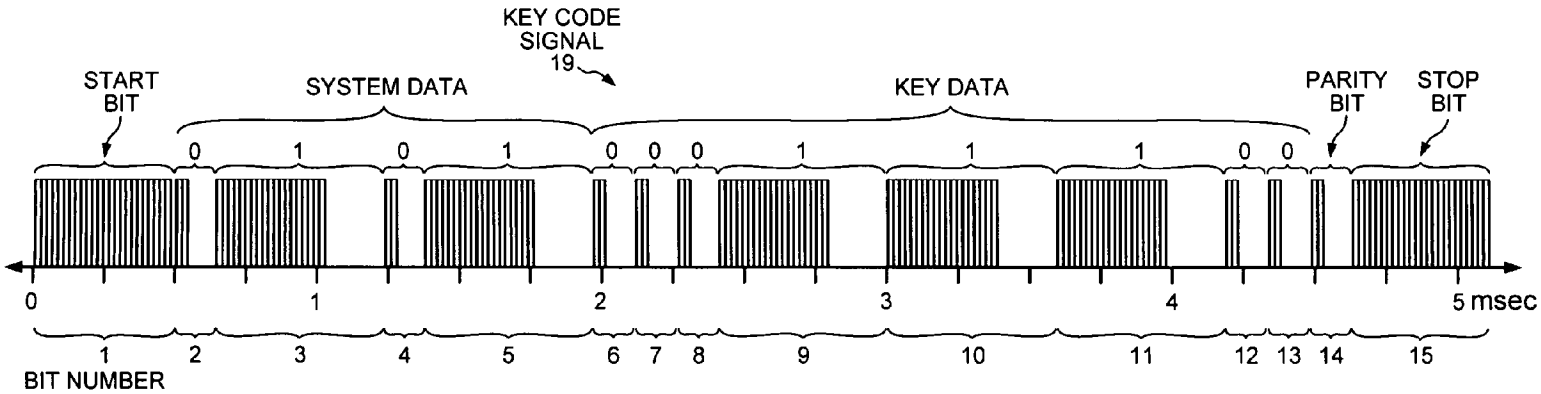
FIG. 5 is a waveform diagram of a second example of a key code signal transmitted by a remote control device in the system of FIG. 1.

FIG. 4 and FIG. 5 illustrate key code signal 19 in two specific embodiments. In both embodiments, the key code is transmitted as a stream of digital values 010100011100, where the system code is transmitted first immediately followed by the key data without any place holders between them. The standardized system code determined in step 102 need not identify the brand or model of VCR 13, but only the fact that first electronic consumer device 13 is a VCR. The key code is modulated in step 103 using timing information associated with the codeset for VCR 13. Thus, the particular brand and model of VCR 13 is able to understand the key code modulated using the appropriate timing information.

In the embodiment of FIG. 4, key code signal 19 is a 15-bit binary transmission whose bit pattern appears as a universal asynchronous receiver and transmitter (UART) type communication. The binary transmission begins with a start bit and ends with a parity bit and a stop bit. The parity bit is calculated based on the 12-bit key code within the binary transmission. In this example, the value of the parity bit is a digital zero. An intermediary signal is transmitted over the first carrier signal at an intermediary frequency (for example, 100 kHz) to communicate a digital one. The absence of the intermediary signal indicates a digital zero. The intermediary signal has a lower frequency than the first carrier signal.

In the embodiment of FIG. 5, the 12-bit key code is modulated onto key code signal 19 using pulse width modulation. Digital ones and zeros are characterized by pairs of marks and spaces. The period between successive leading edges of the bursts in a mark is the period of an intermediary signal. The intermediary signal has an intermediary frequency. In a space, there are no bursts.

Figure 6A:
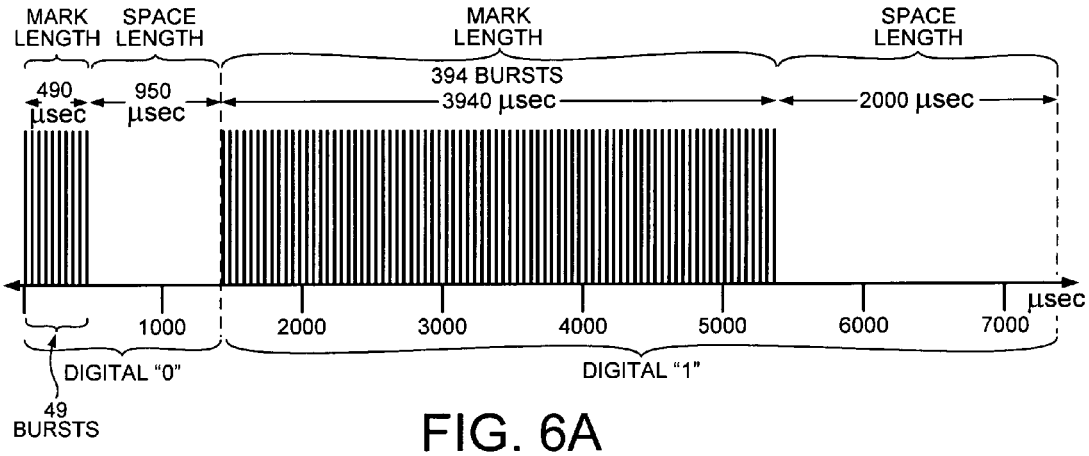
FIG. 6A is an illustration of a modulated digital zero and digital one within the key code signal of FIG. 5.

FIG. 6A shows a digital zero and a digital one in key code signal 19 of FIG. 5 in more detail. A "mark/space" pair represents a digital zero and another "mark/space" pair represents a digital one. The marks and spaces of each pair have predetermined lengths. In the embodiment of FIG. 5, the mark length of a digital zero is 490 microseconds, and the mark length of a digital one is 3940 microseconds. The space length of a digital zero is 950 microseconds, and the space length of a digital one is 2000 microseconds.

Figure 6B:
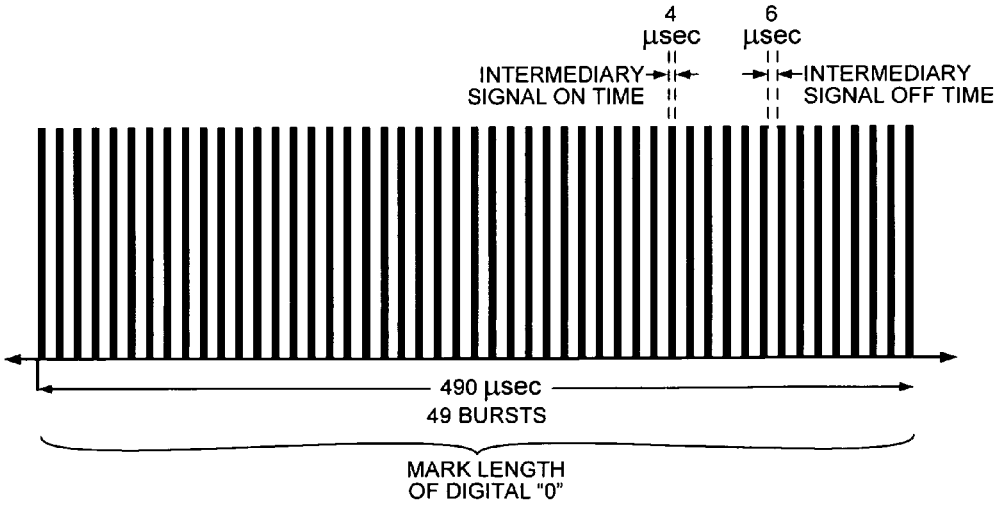
FIG. 6B is a more detailed illustration of a mark of a modulated digital zero within the key code signal of FIG. 5.

FIG. 6B shows the bursts of the first carrier signal that comprise the intermediary signal in more detail. In the embodiment of FIG. 5, the bursts that comprise the intermediary signal occur every ten microseconds, resulting in an intermediary frequency of 100 kilohertz. The duty cycle of the intermediary signal is characterized by an "on time" of four microseconds and an "off time" of six microseconds. There are forty-nine bursts of the carrier signal within each mark length of 490 microseconds.

Timing information other than that shown in the embodiment of FIG. 5 can also be used. For example, one common form of pulse width modulation uses an intermediary signal having a frequency of about 38.5 kilohertz. Each period of the intermediary signal has an "on time" of ten microseconds and an "off time" of sixteen microseconds. If such an intermediary signal were used to generate a 490 microsecond mark length of a digital zero shown in FIG. 6A, there would be 19 bursts of the intermediary signal in the mark. Similarly, if such an intermediary signal were used to generate a 3940 microsecond mark length of a digital one shown in FIG. 6A, there would be 151 bursts of the intermediary signal in the mark.

Next (step 104), an RF transmitter 20 of key code generator device 12 transmits first key code signal 19 in the form of an RF transmission to an RF receiver 21 on remote control device 11.

Next (step 105), remote control device 11 receives first key code signal 19 and relays the key code communicated by first key code signal 19 to VCR 13 in the form of a second key code signal 22. Remote control device 11 is a slave to key code generator device 12. Remote control device 11 relays the key code by receiving first key code signal 19 in RF form and translating the communicated key code so that the key code is modulated onto a second carrier signal resulting in second key code signal 22. In this example, the second carrier signal is an infrared signal with a frequency in the range between three hundred gigahertz and three hundred terahertz. Second key code signal 22 is transmitted by an IR transmitter 23 on remote control device 11 to VCR 13. In the embodiment of FIG. 5, key code signal 19 is converted into key code signal 22 by forming the bursts of the intermediary signal using the second carrier signal with an infrared frequency in the place of the first carrier signal with a radio frequency. For both key code signal 19 and key code signal 22, digital ones and digital zeros are modulated using the same timing for "mark/space" pairs. The waveform diagram of key code signal 22 appears the same as the waveform diagram shown in FIG. 5 for key code signal 19; only the frequency of the carrier signal that forms the bursts is different.

Next (step 106), second key code signal 22 is received onto electronic consumer device (VCR) 13 by an IR receiver 24.

Next (step 107), IR receiver 24 on VCR 13 recovers the key code from second key code signal 22. VCR 13 is thereby instructed to perform the function desired by the user. In this example, the function is to power on VCR 13. Other key codes, however, correspond to other functions, such as power off, channel advance, channel back, volume up, volume down, cursor up, cursor down, cursor right, cursor left, select, play, record, stop, forward, rewind and pause.

In a second example, an electronic consumer device is controlled by an RF key code signal transmitted from key code generator device 12. Subsequent to controlling VCR 13, the user wishes to control second electronic consumer device 14, which is a "Gold" model RCA television set. In the second example, the user uses the on-screen display 15 to identify the type (TV), brand (RCA) and model (Gold) of second electronic consumer device 14. Key code generator device 12 determines the appropriate codeset that controls television set 14. The user then presses a key on remote control device 11 associated with a function that the user wants performed by television set 14. For example, the function is to advance the channel of television set 14. When the user presses the channel advance key on remote control device 11, an indication of the pressed key is transmitted in an RF keystroke indicator signal from remote control device 11 to key code generator device 12.

Key code generator device 12 then determines which key code of the identified codeset corresponds to the pressed key. Key code generator device 12 modulates the key code for the channel advance function onto an RF carrier signal, thereby generating a third key code signal 25. Key code generator device 12 uses the same modulation technique to generate both third key code signal 25 and first key code signal 19. Third key code signal 25 is modulated using timing information associated with the codeset that controls RCA Gold television set 14.

In this second example, television set 14 has an RF receiver 26 and is capable of receiving RF key code signals. RF transmitter 20 of key code generator device 12 transmits third key code signal 25 directly to television set 14. Third key code signal 25 is received onto television set 14 by RF receiver 26, and RF receiver 26 recovers the key code from third key code signal 25. Television set 14 is thereby instructed to advance the channel.

Although remote control device 11 in the first example stores either a proprietary codeset or a standardized codeset and uses that codeset to generate keystroke indicator signal 16, remote control device 11 stores only that single codeset. This codeset is the codeset used by key code generator device 12 to receive communications from remote control device 11. Remote control device 11 can therefore be made inexpensively and may contain a relatively small amount of memory. The memory may, for example, be read only memory (ROM)

on a microcontroller integrated circuit (for example, a Z8 microcontroller available from Zilog, Inc. of San Jose, Calif.)

Even though remote control device 11 stores only a single codeset, system 10 of FIG. 1 nevertheless allows remote control device 11 to control the desired electronic consumer device 13, which may use any one of thousands of different codesets. Key code generator device 12 may, for example, include a hard disk or other mass storage device that stores thousands of possible codesets. The user may use remote control device 11 to select any one of those codesets for communication with the particular electronic consumer device 13. In comparison to some conventional systems where codesets are downloaded into a universal remote control device from a personal computer or other device that is not normally part of an entertainment system, system 10 uses preexisting hardware of the entertainment system (such as the on-screen display functionality, data storage capability, and wireless communication ability of the set-top box) to source and identify codesets.

Although the specific embodiments of FIGS. 1 and 2 are explained above in connection with the codesets being identified to the key code generator device 12 using an on-screen display, the codeset usable to communicate with an electronic consumer device may be identified to key code generator device 12 in other ways in other embodiments. In one embodiment, for example, the key code generator device includes autoscan functionality. Key code generator device 12 includes an EMI detector 27 that detects electromagnetic interference (EMI) or noise on power cord 28. Power cord 28 is a power cord through which key code generator device 12 receives electrical power from a wall socket 29. Similarly, television set 14 receives power from another wall socket 30 via a power cord 31. VCR 13 receives power from a wall socket 32 via another power cord 33. In accordance with the autoscan functionality, key code generator device 12 identifies the codeset used to communicate with a particular electronic consumer device by generating and transmitting a sequence of key code signals relayed through remote control device 11 to the electronic consumer device to be controlled (in this case VCR 13). Each of these key code signals contains a different key code corresponding to the same desired function on different device types, brands and models.

In one example, the desired function is the function of powering on VCR 13. The key code generator device 12 sends the power-on key codes for each of a series of codesets one-by-one to VCR 13. When the key code for one of the codesets causes VCR 13 to perform the desired function (in this case, to power on), VCR 13 introduces noise or other electromagnetic interference via cord 33 into wall socket 32. The power terminal within wall socket 32 is connected through wiring 34 to the power terminal in wall socket 29. The noise generated by VCR 13 is therefore communicated through wiring 34, the power terminal of wall socket 29 and power cord 28 to EMI detector 27 on key code generator device 12. When key code generator device 12 detects the electromagnetic interference on power cord 28, key code generator device 12 automatically identifies the codeset used by VCR 13 as the codeset used to communicate the last key code signal for the power-on function.

Multiple electronic consumer devices may have the same key data for a particular function, for example, the power-on function. A key code, however, also contains a system code (see FIG. 3) that corresponds to a particular type of electronic consumer device. For example, the system code used for a television set will typically be different than the system code used for a video cassette recorder. Thus, different device types that use the same key data for the power-on function will not respond to a key code containing an incorrect system code. Each of the power-on key codes transmitted in this example by key code generator device 12 contains the system code for a video cassette recorder, so television set 14 does not recognize the key codes. Because key code generator device 12 is aware of the system code communicated, key code generator device 12 determines that it was VCR 13 that was powered on and not television 14.

In another example, the codeset usable to communicate with VCR 13 is identified to key code generator device 12 using autoscan functionality that does not involve key code generator device 12 having a specialized EMI detection circuit. In that case, the user may be prompted by successive screens of on screen display 15 to push the power-on key on remote control device 11 multiple times. Each time the power-on key is pressed, keystroke indicator signal 16 communicates this to key code generator device 12. Key code generator device 12 in turn generates and transmits a key code signal containing a power-on key code using a different codeset. Each key code signal is relayed through remote control device 11 to the particular electronic consumer device to be controlled. One by one the user is prompted to push the power-on key, and key code generator device 12 in turn generates key codes using different codesets until the electronic consumer device performs a desired function. In this case, first electronic consumer device 13 turns on. The user is prompted not to press the power-on key once the user sees the desired function being performed by first electronic consumer device 13. In the present example, light emitting diodes (LEDs) on the face of VCR 13 may be illuminated to indicate to the user that VCR 13 has powered on. When the user stops pressing the power-on key, then the key code generator device 12 identifies the codeset of the last transmitted key code to be the codeset used by the electronic consumer device.

In another example, the user presses keys on remote control device 11 to communicate to key code generator device 12 a 3-digit codeset identification number identifying the codeset. The user may determine this codeset identification number by looking up the codeset identification number in a booklet supplied along with the electronic consumer device to be controlled. Alternatively, a table of manufacturers, model numbers and their associated codesets may be used to lookup the codeset identification number.

In an embodiment where key code generator device 12 is a set-top box, the set-top box receives a video input signal 35 from a cable television coaxial cable 36. Video input signal 35 is ultimately delivered to television set 14 through cables 37. Coaxial cable 36 is also used to provide networking connectivity between the set-top box and a network 38. Network 38 may, for example, be or include the Internet. A database of codesets 39 is maintained at a remote location. As new electronic consumer devices are introduced onto the market, new codesets may be necessary to communicate with these new devices. So that one such new codeset can be distributed from database of codesets 39 when a new electronic consumer device is introduced into the market, this new codeset is communicated via network 38 and coaxial cable 36 to key code generator device 12. The new codeset is then stored on a mass storage hard disk within the set-top box. In this way, the pre-existing and inexpensive remote control device 11 can be used to control a new electronic consumer device whose required codeset did not exist at the time remote control device 11 and key code generator device 12 were delivered to the user.

In yet another embodiment, remote control device 11 is a learning remote control device that includes an IR detector 40. In accordance with one method, the learning remote control device 11 is placed so that IR detector 40 can receive an IR transmission from an IR transmitter of another remote control device. Keys corresponding to key codes to be learned are pressed on the other remote control device such that successive key code signals are transmitted from the IR transmitter of the other remote control device to IR detector 40 of the learning remote control device 11. Learning remote control device 11 detects when the envelope of the bursts of the received IR signal changes from low to high and high to low. The time duration between each successive transition is stored such that a key code signal is recorded as timing information for a series of mark lengths and space lengths. As the various keys of the remote control device to be learned are pressed, learning remote control device 11 records successive strings of timing information. The resulting strings of timing information, once collected on learning remote control device 11, are automatically transmitted from learning remote control device 11 in the form of RF signals to key code generator device 12. Key code generator device 12 in turn communicates the captured strings of timing information through coaxial cable 36 and network 38 to database of codesets 39. Personnel maintaining database of codesets 39 then analyze the timing information and generate a codeset that describes the key codes captured by learning remote control device 11. In this way, a new codeset containing key data, systems codes and timing information is added to database of codesets 39. Rather than storing the information as a new codeset that includes separate key codes and timing information, the information for each keystroke can be stored in database of codesets 39 in the form of interval times.

A single system 10 is therefore described that can support numerous different types of electronic consumer devices that can use multiple different codesets. The remote control device 11 of the system need not include a large memory and stored many codesets. Rather, the remote control device 11 need only relay individual key codes. Remote control device 11 can therefore be a relatively inexpensive device that includes only a small amount of memory. In addition to requiring only a small amount of memory, the very same remote control device 11 can control an electronic consumer device that uses a codeset or protocol that was not in existence at the time the remote control device 11 was delivered to the user. The amount of writable memory (for example, random access memory (RAM) or flash memory) on the remote control device 11 may be so little that it may not be adequate to store a conventional codeset. The bulk of the memory of the remote control device 11 may be relatively inexpensive mask-programmable read only memory (ROM). By reducing the amount of writable memory on remote control device 11, the cost of remote control device 11 is reduced.

Although the present invention has been described in connection with certain specific embodiments for instructional purposes, the present invention is not limited thereto. Although the method is described above in connection with an inexpensive remote control device whose primary purpose is to control an electronic consumer device, the method can be employed in connection with other types of devices. Due to the limited amount of memory and intelligence required of the remote control device in the present method, the functionality of remote control device 11 can be incorporated into an RF-enabled device (such as a cell phone or RF-enabled personal digital assistant (PDA) or RF-enabled wrist watch or RF-enabled keyboard) without significantly increasing the cost of the device. The first carrier signal used to communicate between the remote control device and the key code generator device need not be an RF signal, and the second carrier signal used to communicate between the remote control device and the electronic consumer device need not be an IR signal. Both the first and second carrier signals can be the same type of signals, for example IR signals. The key code generator device can transmit key codes to the electronic consumer device to be controlled via a hardwired connection rather than a wireless link. The type of key code signal relayed through the remote control device is not limited to any particular protocol.

Although key code generator device 12 is a set-top box in the embodiment of FIG. 1 above, in other embodiments the key'code generator device 12 is another type of electronic consumer device such as, for example, a television, a stereo radio, a digital video disk player, a video cassette recorder, a personal computer, a set-top cable television box or a set-top satellite box. Although the keystroke indicator signal can be an indication of a pressed key where there is a one-to-one relationship between the key and a function to be performed, in other embodiments a keystroke indicator signal indicates a selected function that is not associated with a specific key on the remote control device. For example, a function can be selected choosing a function from a menu that is displayed on the remote control device. Accordingly, various modifications, adaptations, and combinations of various features of the described embodiments can be practiced without departing from the scope of the invention as set forth in the claims.

What is claimed is:

1. A method comprising:

(a) receiving a keystroke indicator from a remote control device, wherein the keystroke indicator indicates a key on the remote control device that a user has selected;

(b) generating a key code within a key code generator device using the keystroke indicator;

(c) formatting the key code for transmission and thereby generating a key code signal; and (d) transmitting the key code signal from the key code generator device to an electronic consumer device, wherein the key code generated in (b) is part of a codeset, and wherein the codeset comprises timing information that describes a digital one and a digital zero.

2. A method comprising:

(a) receiving a keystroke indicator from a remote control device, wherein the keystroke indicator indicates a key on the remote control device that a user has selected;

(b) generating a key code within a key code generator device using the keystroke indicator;

(c) formatting the key code for transmission and thereby generating a key code signal;

(d) transmitting the key code signal from the key code generator device to an electronic consumer device using a first modulation technique;

(f) determining that the key code signal using the first modulation technique cannot be used to communicate with the electronic consumer device; and (e) transmitting the key code signal from the key code generator device to the electronic consumer device using a second modulation technique.

* * * * *